US007568266B2

(12) United States Patent
Simmen

(10) Patent No.: US 7,568,266 B2
(45) Date of Patent: Aug. 4, 2009

(54) METHOD AND ENTANGLEMENT NOZZLE FOR REPRODUCING KNOTTED YARN

(75) Inventor: Christian Simmen, Wattwil (CH)

(73) Assignee: Oerlikon Heberlein Temco Wattwil AG, Wattwil (CH)

( * ) Notice: Subject to any disclaimer, the term of this patent is extended or adjusted under 35 U.S.C. 154(b) by 0 days.

(21) Appl. No.: 11/886,767

(22) PCT Filed: Mar. 16, 2006

(86) PCT No.: PCT/CH2006/000155

§ 371 (c)(1),
(2), (4) Date: May 8, 2008

(87) PCT Pub. No.: WO2006/099763

PCT Pub. Date: Sep. 28, 2006

(65) Prior Publication Data

US 2009/0031693 A1 Feb. 5, 2009

(30) Foreign Application Priority Data

Mar. 20, 2005 (CH) ..... 0482/05
Oct. 4, 2005 (CH) ..... 1608/05

(51) Int. Cl.
*D02G 1/16* (2006.01)
*D02J 1/08* (2006.01)

(52) U.S. Cl. ..... 28/275; 28/271

(58) Field of Classification Search ..... 28/271, 28/274, 275, 276, 272, 273, 254, 283; 57/350, 57/908, 333, 289
See application file for complete search history.

(56) References Cited

U.S. PATENT DOCUMENTS 3,262,179 A * 7/1966 Sparling ..... 28/274
3,448,501 A * 6/1969 Buzano ..... 28/271
3,474,510 A * 10/1969 Torsellini ..... 28/275
3,730,413 A * 5/1973 McDermott et al. ..... 28/272
4,064,686 A * 12/1977 Whitted et al. ..... 57/208
4,069,565 A * 1/1978 Negishi et al. ..... 28/272
5,010,631 A * 4/1991 Ritter ..... 28/274

(Continued)

FOREIGN PATENT DOCUMENTS

DE 3711759 3/1988

(Continued)

*Primary Examiner*—Amy B Vanatta
(74) *Attorney, Agent, or Firm*—Shoemaker and Mattare

(57) ABSTRACT

The invention relates to an entanglement nozzle and to a method for producing fine knotted yarn with highly regular knots by means of air jets comprising a yarn treatment channel. According to said method, air is blown transversally to the yarn treatment channel. Said blown air forms a respective double swirl both in the yarn transport direction and against the yarn transport direction for creating the knots. According to the invention, upon entry into the yarn treatment channel, the blown air is converted into two intense, stationary eddy currents that are not disrupted by filament bundles, in an air swirling chamber that only extends for a short distance in the longitudinal direction of the yarn channel. The regularity of the knots can be significantly improved, despite the tiny dimensions of the air swirling chamber, which projects beyond the longitudinal wall of the yarn channel for a maximum 0.5 mm or for 5% to 22% of the width (B) of said channel. It is also possible to create hard or soft knots that can be subsequently undone.

27 Claims, 13 Drawing Sheets

Figure 2A:
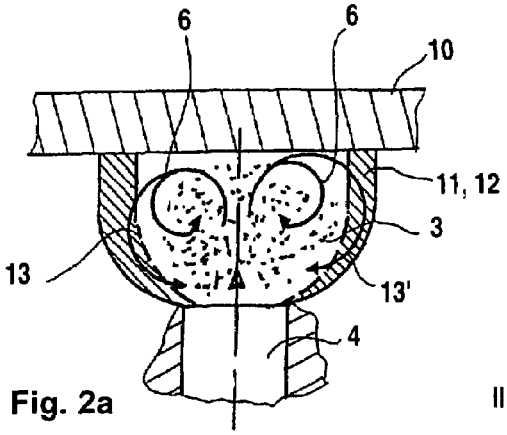

U.S. PATENT DOCUMENTS 5,146,660 A * 9/1992 Ritter ..... 28/274
6,134,759 A * 10/2000 Saijo et al. ..... 28/274
6,438,812 B1 * 8/2002 Jansen ..... 28/274
6,834,417 B1 * 12/2004 Buchmuller ..... 28/271
7,353,575 B2 * 4/2008 Buchmuller ..... 28/271
2009/0007403 A1 * 1/2009 Belforte et al. ..... 28/275

FOREIGN PATENT DOCUMENTS

DE 19700817 7/1997
EP 1092796 4/2001

* cited by examiner

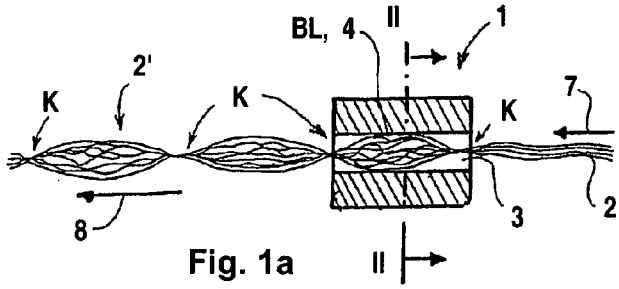
Fig. 1a
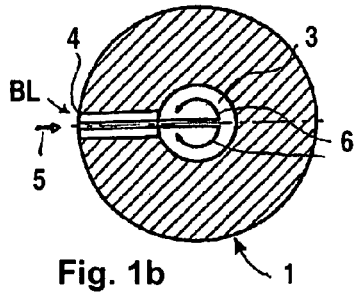
Fig. 1b
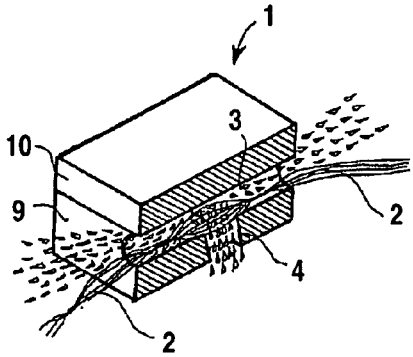
Fig. 1c
Fig. 1d
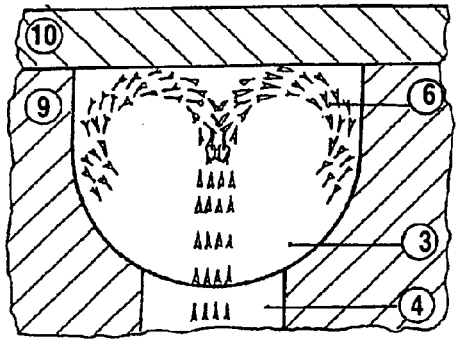
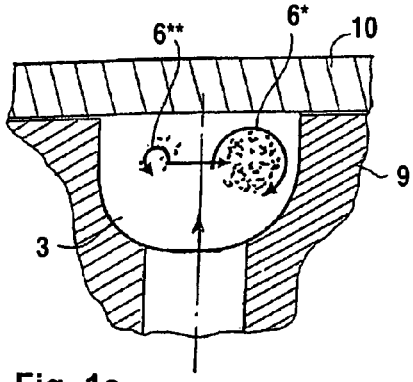
Fig. 1e
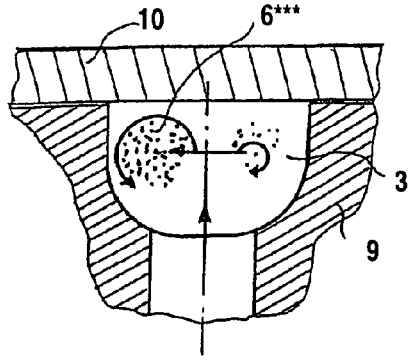
Fig. 1f Fig. 5a
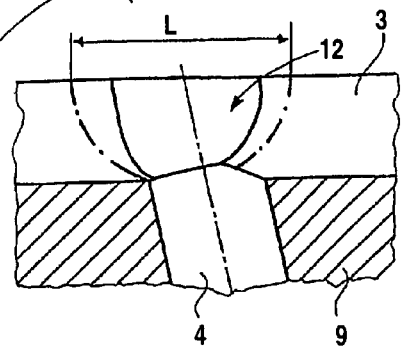
Fig. 5b
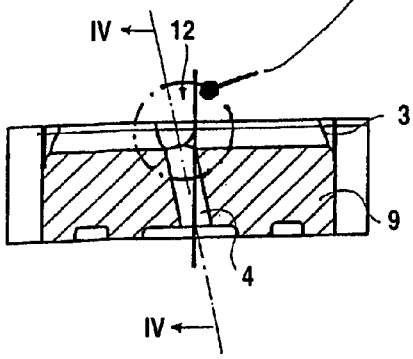
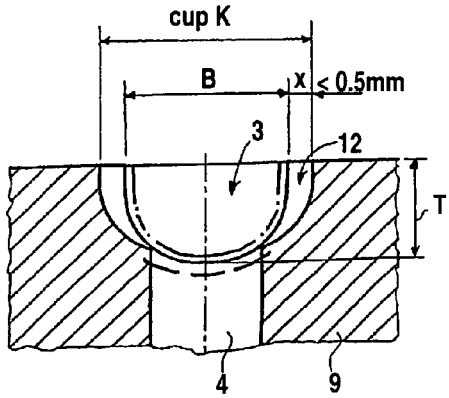
Fig. 5c
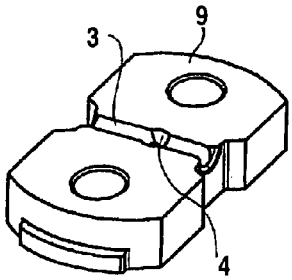
Fig. 5d
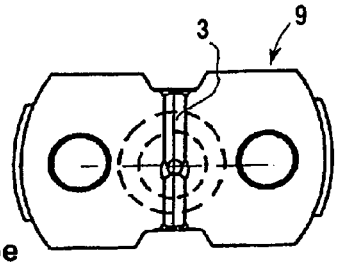
Fig. 5e

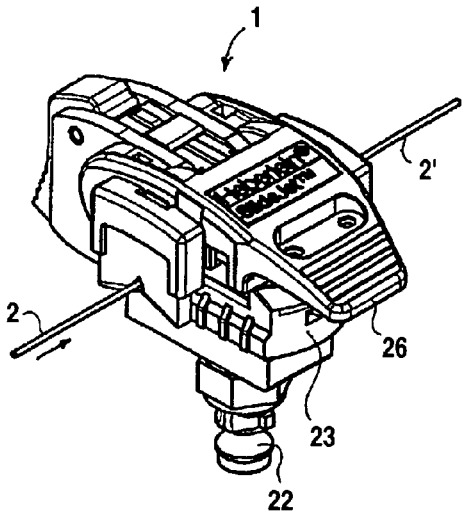
FIG 6a
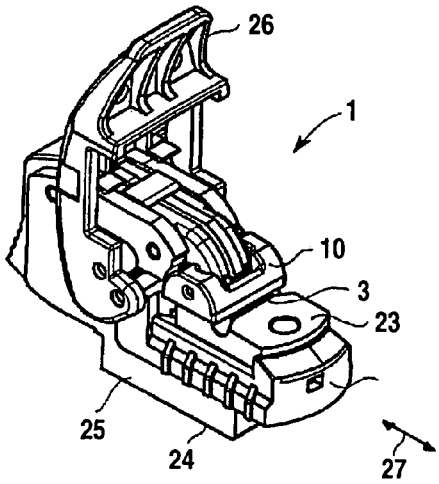
FIG 6b
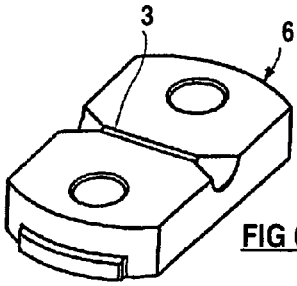
FIG 6c
FIG 6d
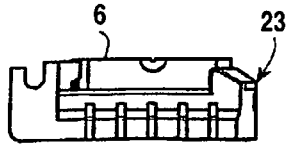

26
4

26
4
23
105°
G 23
26
K 10
3

10
21

6
23 g
43
42
23 g
23 rotate plate
13

23

FIG 9a
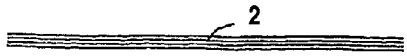
FIG 9b
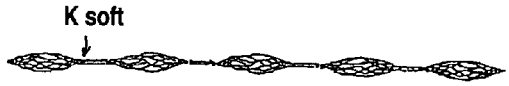
FIG 9c
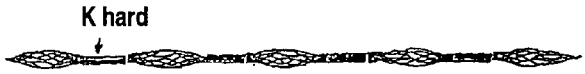
FIG 9d
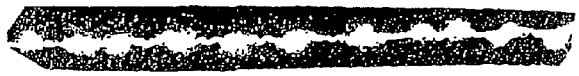
FIG 10a
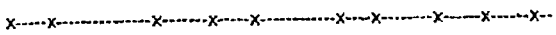
FIG 10b
FIG 10c
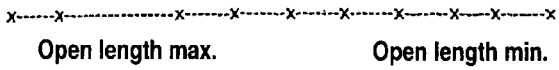
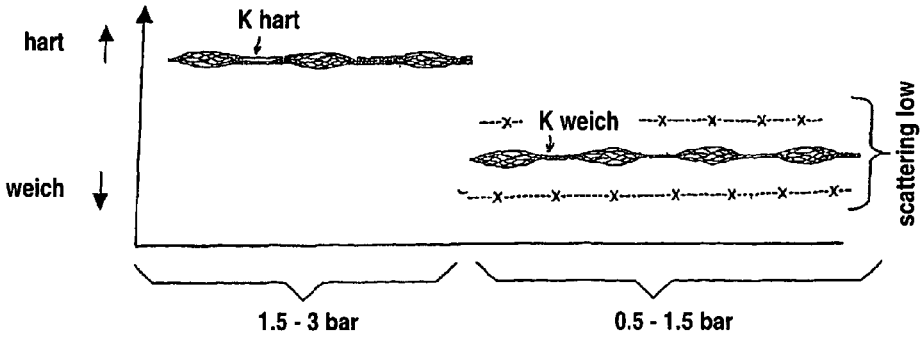
FIG 11

FIG 12a
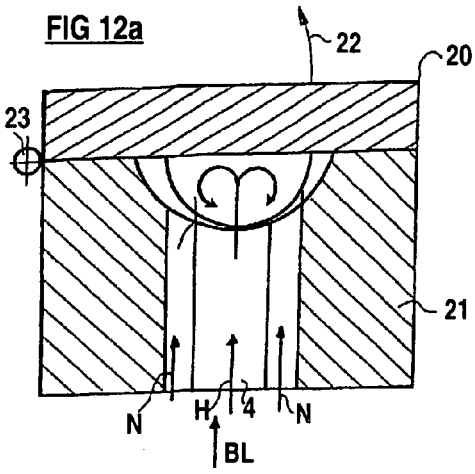
FIG 12b
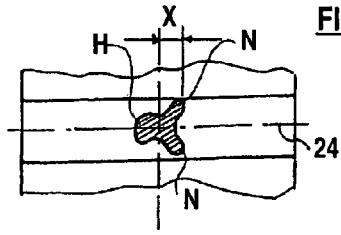
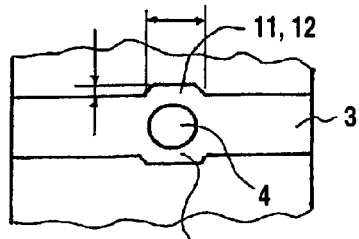
FIG 12c
FIG 13c
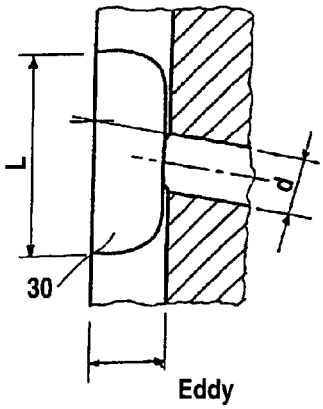
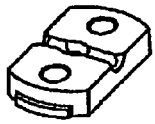
FIG 13d
FIG 13b
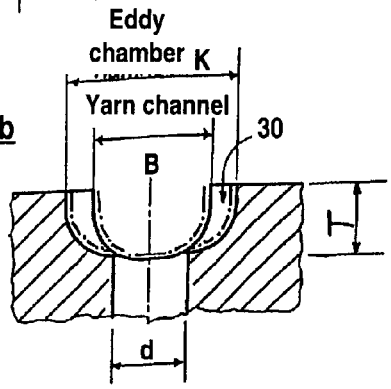
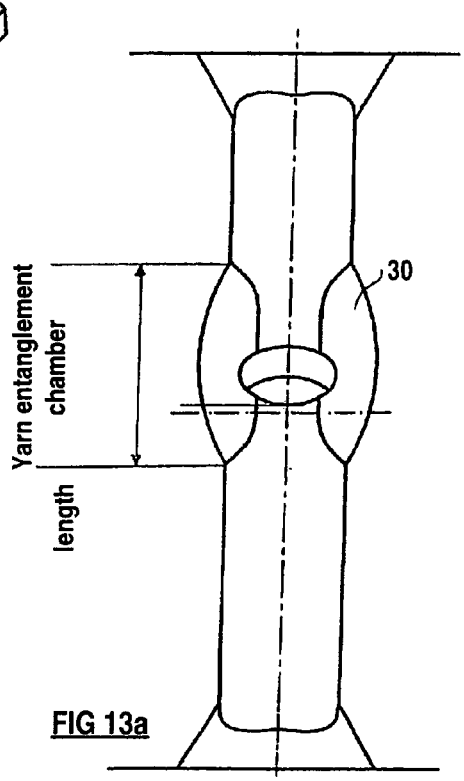
FIG 13a State of the Art

L < L*, L**

Analysis Itemat Lab
Date: 13.12.2004
Test length: 20m
Test Speed: 100m/min.
Cup K
Kalotte K (mm)
Kanal B 1,6mm
Channel
D
1,1 mm
Depth T = 1.0 mm Yarn: (PES dtex 83f34 (grob)
3.2 - 4% of (overfeed)
aFK, vW2 900 m/min
Fp/m
No continuous chamber B
K=2,2mm
K=2,4mm
K=2,6mm
K=2,8mm
CV(%)_Fp/m
Stability (%) bel 1.0 cN/dtex
p [bar]
K = 0
K = 2.2
K = 2.4
K = 2.6
K = 2.8

PES dtex 83f34 flat yarn, fully drawn

1000 m / min. 26.09.2005

Air flow channel diameter (bore)
P231: d=1.4 mm
X40.10: d=1.4 mm

Yarn channel width
B=2 mm no AirTwish Chamber
B=2.1 mm AirTwist Chamber K=2.6

METHOD AND ENTANGLEMENT NOZZLE FOR REPRODUCING KNOTTED YARN

TECHNICAL FIELD

The invention relates to a method for producing knotted yarn and/or twisted yarn from DTY (draw twist yarn) and/or smooth yarns with highly regular knots by means of air nozzles with a yarn treatment channel as well as blown air which is blown in transverse to the yarn treatment channel, with the blown air creating one double eddy each in the direction of yarn transport as well as against the direction of yarn transport to create the knots. The invention additionally relates to an entanglement nozzle for producing knotted yarn having highly regular knots, with a continuous yarn treatment channel as well as a blown air feed channel, with the blown air feed channel being directed toward the longitudinal reference axis of the yarn treatment channel.

STATE OF THE ART

In recent times, the filaments being produced have become increasingly finer. They are called microfilaments if the denier per filament (dpf) is between 0.5 and approx. 1.2. The yarns produced from said filaments are called microfilament yarns. The term "super-microfilaments" refers to yarns with a dpf of <0.5. The term "microfilament" in the following also includes super-microfilaments, unless noted otherwise. Yarns with a dpf greater than 1.2 already require gentle processing to avoid breakage of either individual filaments or the entire yarn. This applies even more so to microfilament yarns. With microfilament yarns, the composite of all filaments plays an important role. It must be ensured that no individual filaments protrude and thus create a risk of breakage. "DTY yarns" are "draw twist yarns."

In the market, entangled yarns with so-called air entanglement are used on a relatively large scale. Two trends have become apparent on the market. Well-developed, strong and stable knots, well-formed by air entanglement, are required for many applications. The air nozzle must be designed for this with respect to all parameters. The situation is different with fine filament yarns, especially microfilament yarns. These yarns are used to produce fine fabrics, which must have a very supple and silky feel to the touch. It is found here that the development of very stable knots that are almost impossible to undo may be a disadvantage in that the knots act as a type of grid, especially on extremely fine fabric dyed in a solid color. Although knots may be desired within yarn processing, they should subsequently disappear completely during the processing of the fine yarns to woven fabrics or other fabrics. So-called knotted yarn is produced by entanglement using entanglement nozzles. The knots ensure local incorporation of all filaments and short sequences of knots over the entire yarn run. The goal of entanglement is to achieve a high knot count per meter with regular spacing between knots. The conditions in terms of equipment are given with a yarn treatment channel having a blown air feed running across the yarn channel. In this process, the blown air flows out on both sides of the yarn channel, forming a so-called double eddy due to the air being blown approximately centrally in the direction of yarn transport and also opposite the direction of yarn transport. When the yarn is passed through the corresponding eddy zone, this results in a type of alternating air movement which is ultimately partially responsible for repetitive formation of knots with short interruptions between the knots. The skill here lies in finding the optimum among the three yarn quality criteria:

knot stability,
knot count per meter,
regular knot formation for the respective application with a targeted embodiment of all dimensions of the yarn channel of an entanglement nozzle as well as the type of air feed, the air pressure, delivery and yarn transport speed. In the case of coarser filaments of dpf 1.2-4, a knot count of up to 110 per meter of yarn is desired, and in the case of microfilament yarns a knot count of up to 200 per meter of yarn is desired. For microfilaments the air pressure is approx. 0.5 to 1.5 bar. The forward slip is 3%-6%. In the state of the art, 140 points, i.e., knots, are created with fine filaments per meter of yarn length. The most regular possible knot sequence is desired here. Knot-free yarn segments, where one or more knots in succession are missing, should be prevented. The measure of stability is the tensile force at which the knots become untangled again. In the simplest method of testing this, the yarn is held between two hands and then stretched out slowly or suddenly.

DE 197 00 817 shows a special form of an entanglement nozzle for carpet yarn, i.e., for very coarse BCF yarn. A method for continuous production of spin-textured filament yarn in a continuous yarn channel and/or entanglement channel of a swirl nozzle has been assumed. The filament yarn is entangled by a stream of blown air directed transversally into the swirl nozzle and flowing out of the yarn channel in both forward and reverse directions, and the exhaust air of the rear eddy is released from the yarn feed area approximately opposite the blown air feed. The approach proposed here is to produce two unequally strong eddies in the entanglement channel, the forward eddy being designed to have a stronger effect than the rear eddy.

DE 37 11 759 is directed to finer yarns to medium yarns and attempts to improve the processability of the yarn in the subsequent processing, e.g., on weaving, knitting, weft-knitting and tufting machines. The inventor describes an entanglement device for entanglement of multifilament yarns, said machine having at least one yarn channel, with yarn guides arranged at intervals from the inlet opening to the outlet opening of the yarn channel and each of the filaments of a multifilament yarn being entangleable in the yarn channel by means of a blowing nozzle of compressed air that can be blown into it. The yarn undergoes a change of direction of less than 90° on entering and departing from the yarn channel and the blowing angle of the air nozzle is less than 90°. As a new approach, it is proposed here that the yarn guides shall be arranged in such a way that they guide the yarn into the yarn channel when the compressed air feed is shut down so that the yarn extends through the yarn channel, where it is parallel to the longitudinal direction of the latter and is in contact with the outlet opening of the at least one air nozzle. The distance of the yarn guides from the neighboring yarn channel openings is max. 30 mm. The length of the yarn channel is max. 40 mm with uncrimped multifilament yarn and max. 30 mm with crimped multifilament yarn. DE 37 11 759 at least succeeds in introducing the finding of the positive effect of a short yarn channel for production of knotted yarn to a broader technical world. In concrete terms, a yarn channel length of 10-28 mm is proposed for textured and/or crimped yarn. In particular a yarn channel length in the range of 10 mm is understood to be short.

The latest findings have shown that the use of air nozzles for the production of knotted yarn, which is widespread per se, is not satisfactory with very fine filaments, especially microfilaments. With regard to fine yarns, in particular microfilament yarns, in any case, however, a highly regular knot sequence is required in certain applications with weak knots that are temporarily constant but are reversible, i.e., knots that are undone again during yarn processing. The knots must not be discernible in the finished fabric. There have been many attempts to operate state-of-the-art nozzles, e.g., with lower air feed pressures. It is known that weaker knots are formed at lower air pressures but this is associated with the frequently unacceptable disadvantage of a lack of regularity in knot strength and/or knot stability as well as the spacing between knots.

Recently the market has shown a very strong trend toward the use of so-called microfilament yarns. The question of the regularity of the knots and at least adequate stability of knots for further processing plays a central role in many applications. In most cases, the number of knots must not be significantly less than 140 knots/m, which is achievable at the present time. Furthermore, the pressure required for the blown air must be reducible in view of the energy consumption.

The object of the present invention is to discover a method and an entanglement nozzle with which the aforementioned quality criteria can be achieved in the production of fine filament yarns, in particular microfilament yarns, even at high yarn transport speeds, with the four objectives:

pressure reduction for the blown air,
knot count per meter >140/m for dpf <1.2,
adjustable knot stability,
highly regular knot sequence.

DESCRIPTION OF THE INVENTION

The inventive method is characterized in that the blown air in the inlet area to the yarn treatment channel creates two strong stationary air eddy currents, virtually undisturbed by filament bundles, in an air twist chamber.

The entanglement nozzle in accordance with the invention is characterized in that a blown air channel enlargement is formed in the opening area of the blown air feed channel in the yarn treatment channel to form an air twist chamber for two stationary air eddy currents in opposite directions, whereby the blown air channel enlargement protrudes by less than 22% but more than 5% of the yarn channel width.

With respect to the novel invention, two entanglement nozzles are known in the state of the art:

First, entanglement nozzles having continuous yarn channels, e.g., as described in DE 37 11 759, which is cited in the introduction. A uniform continuous yarn channel is typical here.

Second, there are entanglement nozzles with a yarn entanglement chamber in the area of the blown air feed into the yarn channel. This is based on the model wherein the opened individual filaments of the yarn require an additional chamber to [allow] decay at the side and thus achieve improved knot stability.

It is interesting here that a high knot count is achieved in the former case. However, it is a disadvantage that the stability of the knots and the regularity of the knot sequence are tangibly inferior even with a slight reduction in the blown air pressure. In the second case, the knot stability is adequate but the knot count is not sufficient for many applications.

This novel invention is a departure from the so-called vortex chamber. A vortex chamber is understood to comprise a relatively great enlargement of the yarn channel before and after the area of the air injection site. The purpose was to give the yarn, i.e., the individual filaments, an opportunity to oscillate back and forth within the vortex chamber. However, the novel invention seeks an improvement on the air side. An air twist chamber or micro-vortex chamber for the air is proposed. It is true that knot stability has been increased with the vortex chamber. However, this has been achieved at the expense of the knot count. Fewer knots are created per meter of yarn. However, the individual knots are longer. In a completely surprising result, laboratory experiments with the novel inventive approach revealed that a knot stability that was previously impossible to achieve with uniform knots could be achieved with virtually no sacrifice with regard to the knot count. The micro vortex for air alone is possible because the local air flow is in the sonic and supersonic range and supersonic flow phenomena are utilized by inducing two strong stationary air eddy currents in a locally limited manner.

The inventor has also recognized that an inadequate model of knot formation was assumed in the previous methods. The contra-rotating eddies in each direction of outflow are stable as long as no yarn is present in the yarn channel. The presence of the yarn causes the eddy to oscillate back and forth. Investigations by the applicant have shown that the very short-term back and forth oscillation of the two contra-rotating eddies is at the center of the knot forming process. A combination of the two large eddies and an indefinable number of extremely small eddies causes the individual filaments to be thrown back and forth and thereby knotted. It is a fact here that the contra-rotating eddies are completely unstable when yarn is being transported through the yarn channel. On the other hand, according to the state-of-the-art model, attempts have been limited to the development of double eddies. This overlooks the resulting contradiction. The inventor has now recognized that the situation in the treatment of fine yarns can be tangibly improved if, instead of a continuous uniform yarn channel or a yarn eddy chamber, an air twist chamber is mounted in the blown air inlet area in the yarn treatment channel, so that the air stream creates two strong, undisturbed eddy currents at the respective location. The air twist chamber constitutes a miniature blown air channel enlargement and forms a transition between a completely stable eddy current in the area of air injection and the adjacent eddy zone, which is just as completely unstable, up to the outlet from the yarn channel. There is thus a sharp eddy formation in the direction of yarn transport and also opposite the direction of yarn transport. Air flow is at sonic or supersonic speed, so the corresponding phenomena may additionally be utilized.

The present invention allows a number of advantageous embodiments. In the model used here, a short area with a stable eddy current is created in the air twist chamber, followed by an alternating eddy zone in the direction of yarn transport and also opposite the direction of yarn transport. The table below summarizes the various types of yarns with the corresponding filament fineness.

Endless Filament Yarns: Classification of Conventional Yarn and Filament Fineness

| Yarn type | Denier per filament (dpf) | | | | | | | | |
|---|---|---|---|---|---|---|---|---|---|
| | DTY yarns (false twist) | | | Smooth yarns | | | BCF yarns (bulk continuous filament) | | |
| Yarn fineness<br>Titer (denier) | Fine<br>20-75 | Medium<br>75-150 | Coarse<br>>150 | Fine<br>40-300 | Medium<br>300-1000 | Coarse<br>>1000 | Fine<br>500-1000 | Medium<br>1000-3000 | Coarse<br>3000-7000 |
| Filament fineness | | | | | | | | | |
| Super micro | 0.2-0.5<br>S-M | 0.2.-0.5<br>S-M | | 0.2-0.5 | | | | | |
| Micro | 0.5-1.2<br>S-HD | 0.5-1.2<br>S-HD | 0.5-1.2<br>M-HD | 0.5-1.2 | | | | | |
| Fine | 1.2-2 | 1.2-2<br>M-HD | 1.2-2<br>M-HD | 1-2 | | | 5-10 | 5-10 | 5-10 |
| Medium | | 2-4<br>HD | 2-4<br>HD | 2-5 | 2-5 | | | 10-20 | 10-20 |
| Coarse | | 2-6<br>HD | 2-6<br>HD | | 5-10 | 5-20 | | 20-30 | 20-30 |

Interlace stability:
S = soft
M = medium
HD = hard

Large-scale experimental series with the inventive approach have shown that for the blown air, compressed air at more than 0.5 bar but less than 3 bar may be used, and a knotted yarn with highly stable knots can be produced. Yarns finer than 2 to 5 dpf, especially less than 1 dpf, were treated in this way. The yarn channel cross section is preferably designed to be a semicircle or U-shaped, with the yarn channel width (W) being greater than the yarn channel depth (D). The air twist chamber is a cup-shaped air channel enlargement in the yarn channel. The air twist chamber is designed to be at least approximately symmetrical, protruding less than 0.5 mm beyond the lateral yarn channel walls on both sides. One very important feature of the new approach is that the air twist chamber is designed in a miniaturized form, so the yarn bundle cannot penetrate completely into the lateral enlargement of the air twist chamber. The air twist chamber protrudes beyond the yarn channel wall by only a fraction of one millimeter. For example, for a yarn channel 1.6 mm wide, the greatest width of the air chamber as proposed here is 2.2 mm. For all those involved, it was initially completely surprising that such major effects could be achieved with such a tiny adjustment. However, the explanation lies in the targeted embodiment of supersonic air flow.

The novel invention has been investigated with large-scale experimental series using DTY yarns (false twist yarns). The results were good with fine, medium and coarse yarns. Results were most surprising in the case of fine yarns, especially microfilament yarns. Preliminary experiments with smooth yarns were positive, although the result turned out to be less clear-cut in relation to DTY yarns. The novel invention may also be used with BCF yarns, at least on the basis of theoretical considerations, in which case the air twist chamber should protrude max. 22%, min. 5% of the yarn channel width in the case of BCF yarns because of the much larger yarn channel widths of up to 8 mm.

The novel invention also allows a large number of advantageous embodiments of the yarn entanglement nozzle. For example, it is proposed that the yarn treatment cross section should be designed to be semicircular or U-shaped and should have a planar baffle cover.

All experiments have shown clearly that the actual critical dimensions of the air twist chamber include the lateral protrusion and the longitudinal dimensions. The air twist chamber is designed as a miniaturized cup with respect to the cross section of the yarn treatment channel to have a similar shape at the side, with the air twist chamber protruding less than 0.5 mm beyond the yarn treatment channel on both sides. The protruding amount of less than 0.5 mm has been confirmed with yarns up to 500 denier, i.e., with yarn channel widths up to 3 mm.

Comparative Experiments: Influence of the Eddy Chamber Length

| Channel width W (mm) | Eddy chamber depth (% of W) | Eddy chamber length (mm) | Experimental result |
|---|---|---|---|
| 2.4 | 25% | 4.21 | State of the art |
| 2.35 | 17.0% | 2.17 | good*** according to invention |
| 1.6 | 0% | 0 | State of the art |
| 1.6 | 18.8% | 1.51 | good***, ref according to invention |
| 1.6 | 18.8% | 1.81 | good** |
| 1.6 | 18.8% | 2.11 | poor* |
| 1.6 | 18.8% | 2.51 | poor* |
| 1.6 | 18.8% | 3.01 | poor* |

*= Loss of knots, stability and uniformity
**= Slight loss of knots, slight gain in stability
***= Optimal result with inventive approach With yarn channel widths greater than 3 mm, a protruding amount of less than 22% and more than 5% of the yarn channel width is specified. The protruding amount is preferably between 10% and 20% of the yarn channel width. The air twist chamber also preferably has an approximately circular symmetrical outside contour and forms an extension of the central axis of the blown air feed channel. To intensify the development of lateral air eddies, the width of the yarn channel cross section is most especially preferably greater than the yarn channel depth in the direction of the blown air feed. The [yarn] treatment channel may be designed as a wide channel having a width of preferably 0.6 to 3 mm, especially preferably with a ratio of the yarn channel width (W) to the yarn channel depth (D) of 1.2 to 2.5. According to experiments, the length of the air twist chamber is preferably less than 1.3 times the yarn channel width. The length of the air twist chamber in relation to the width of the yarn channel is preferably approximately 0.7 to 1.6, preferably 0.8 to 1.2, which is significantly less than the LAN ratio of approximately 1.75 times that of the state of the art.

According to another preferred embodiment idea, the blown air feed channel is designed to be round or oval or oval with a triangular character or Y-shaped, the side dimension of the blown air feed channel being at most equal to or less than the corresponding yarn channel width. The yarn channel width (W) is designed to be greater than the air feed channel width d, preferably with a W/d ratio of 1.1 to 3.

According to another very advantageous approach to achieving this effect, it is proposed that the yarn channel shall be formed by a planar displaceable baffle plate and a nozzle plate with the blown air feed. The yarn channel is preferably designed by a nozzle plate and a baffle plate that is displaceable thereto (as a so-called SlideJet) with an open position of the yarn channel for threading the yarn into it and a closed position of the yarn channel for producing a knotted yarn. The nozzle plate is designed as a plate-shaped ceramic disk, so that the ceramic disk together with a sliding part can be installed into and removed from the entanglement nozzle and/or the ceramic disk as a replaceable plate can be installed into and removed from the sliding part.

BRIEF DESCRIPTION OF THE INVENTION

Figure 3A:
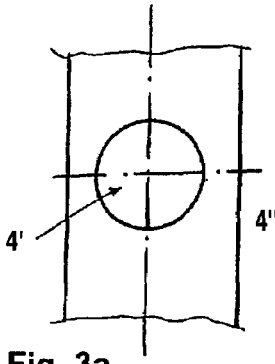
Figure 3B:
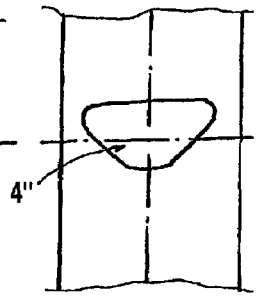
Figure 3C:
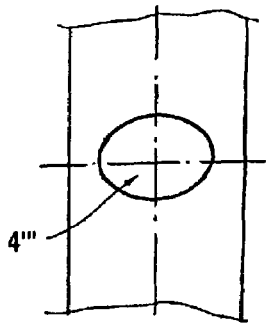
Figure 4A:
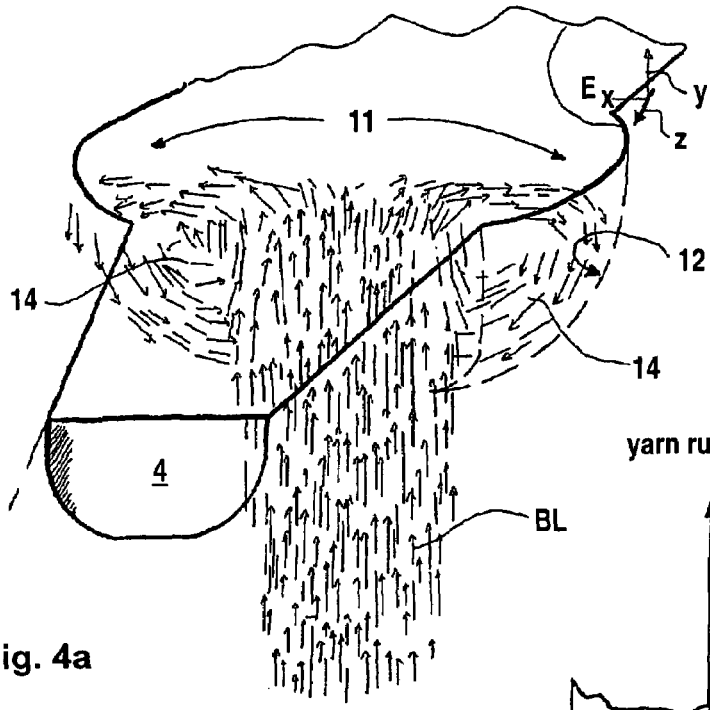
Figure 4B:
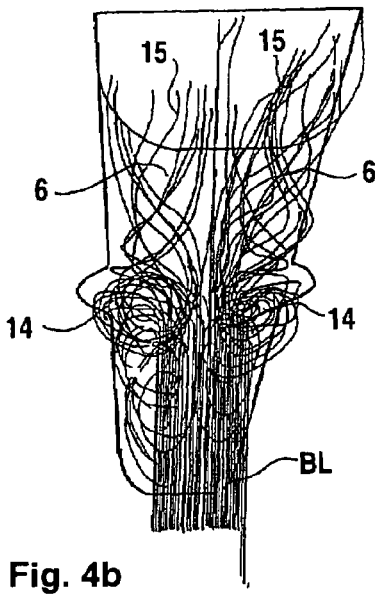
Figure 4C:
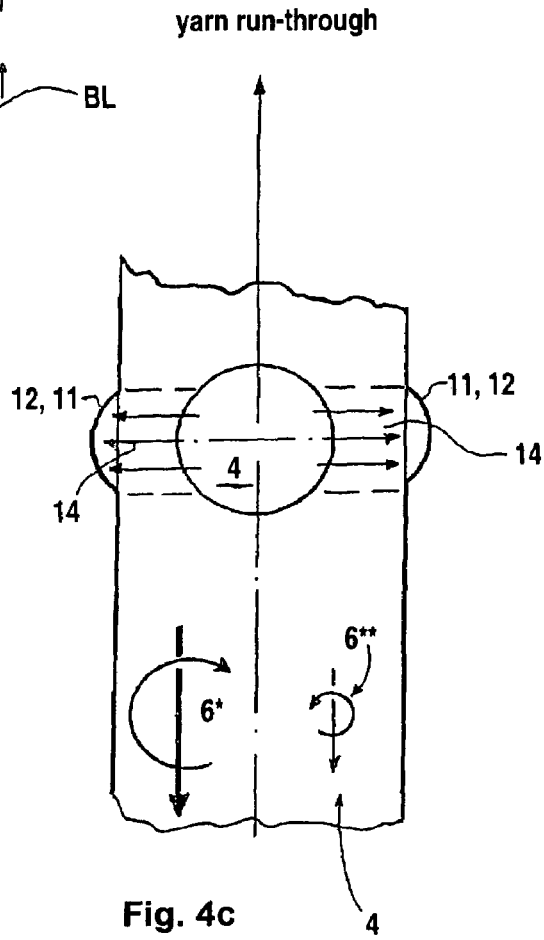
Figure 14A:
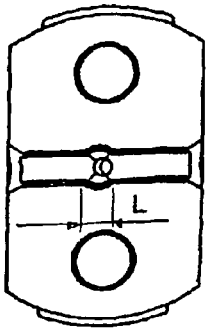

The present invention will now be explained in greater detail on the basis of a few exemplary embodiments with additional details, in which:

FIGS. 1*a*-1*f* show the embodiment of the state-of-the-art yarn treatment channel with the new findings of the contra-rotating eddies on both outflow sides;

FIGS. 2*a*-2*d* show the inventive approach with an air twist chamber;

FIGS. 3*a*-3*c* show various cross-sectional shapes of the blown air feed channel;

FIG. 4*a* shows the result of a model calculation for strong, stationary eddy currents in the area of the air twist chamber;

FIG. 4*b* shows the non-stationary eddies, which are stationary in the model calculation in the absence of yarn;

FIG. 4*c* shows a schematic model of the stationary eddy currents in the area of the air twist chamber and the non-stationary eddies in the two outflow directions of the treatment air;

FIGS. 5*a*-5*e* show different details of a nozzle plate with air twist chambers mounted thereon;

FIGS. 6*a*-6*d* show a complete entanglement nozzle of the SlideJet type in the open and closed positions and with the nozzle plate removed (FIGS. 6*c* and/or 6*d*);

FIGS. 7*a*-7*f* show the most important following steps for removal of the sliding plate and/or the nozzle plate;

FIGS. 8*a*-8*d* show the installation and/or removal of a nozzle plate in a sliding part of the entanglement nozzle;

FIG. 9*a* shows schematically an untreated smooth yarn;

FIG. 9*b* shows a knotted yarn with soft knots;

FIG. 9*c* shows a knotted yarn with hard knots (dark lines);

FIG. 9*d* shows a state-of-the-art knotted yarn with very irregular knot formation;

FIGS. 10*a*-10*c* in contrast with FIGS. 9*c* to 9*d*, show irregularities in knot sequence, some of them with different spacings, some of them with missing knots;

FIG. 11 shows a comparison of hard knots that virtually cannot be undone again and were created with compressed air at 1.5 to 3 bar; at the right of the figure can be seen soft knots that were created with compressed air at 0.5 to 1.5 bar and usually become undone again in the course of yarn processing;

FIGS. 12*a* and 12*b* show a special form of the blown air feed channel with a Y-shaped cross section;

FIG. 12*c* shows another example of the embodiment of an inventive air twist chamber 11';

FIGS. 13*a* through 13*d* show a state-of-the-art approach by the present applicant with an oversized yarn entanglement channel;

FIG. 14*a* shows an inventive approach and

Figure 14B:
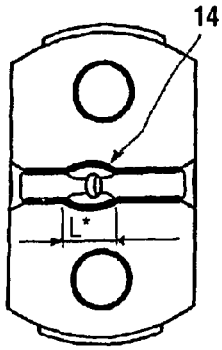
Figure 14C:
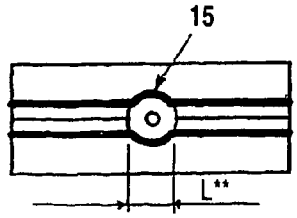

FIGS. 14*b* and 14*c* show state-of-the-art approaches for comparison with FIG. 14*a;*

Figure 15A:
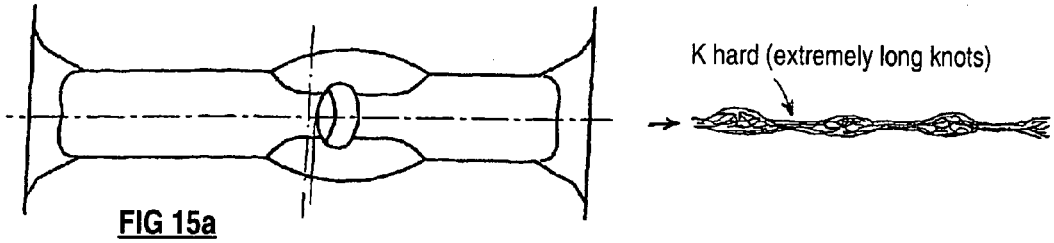
Figure 15B:
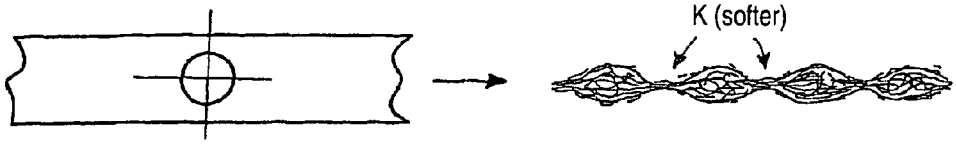
Figure 15C:
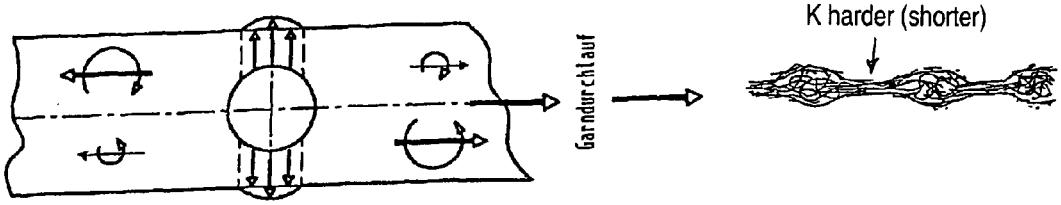
Figure 16A:
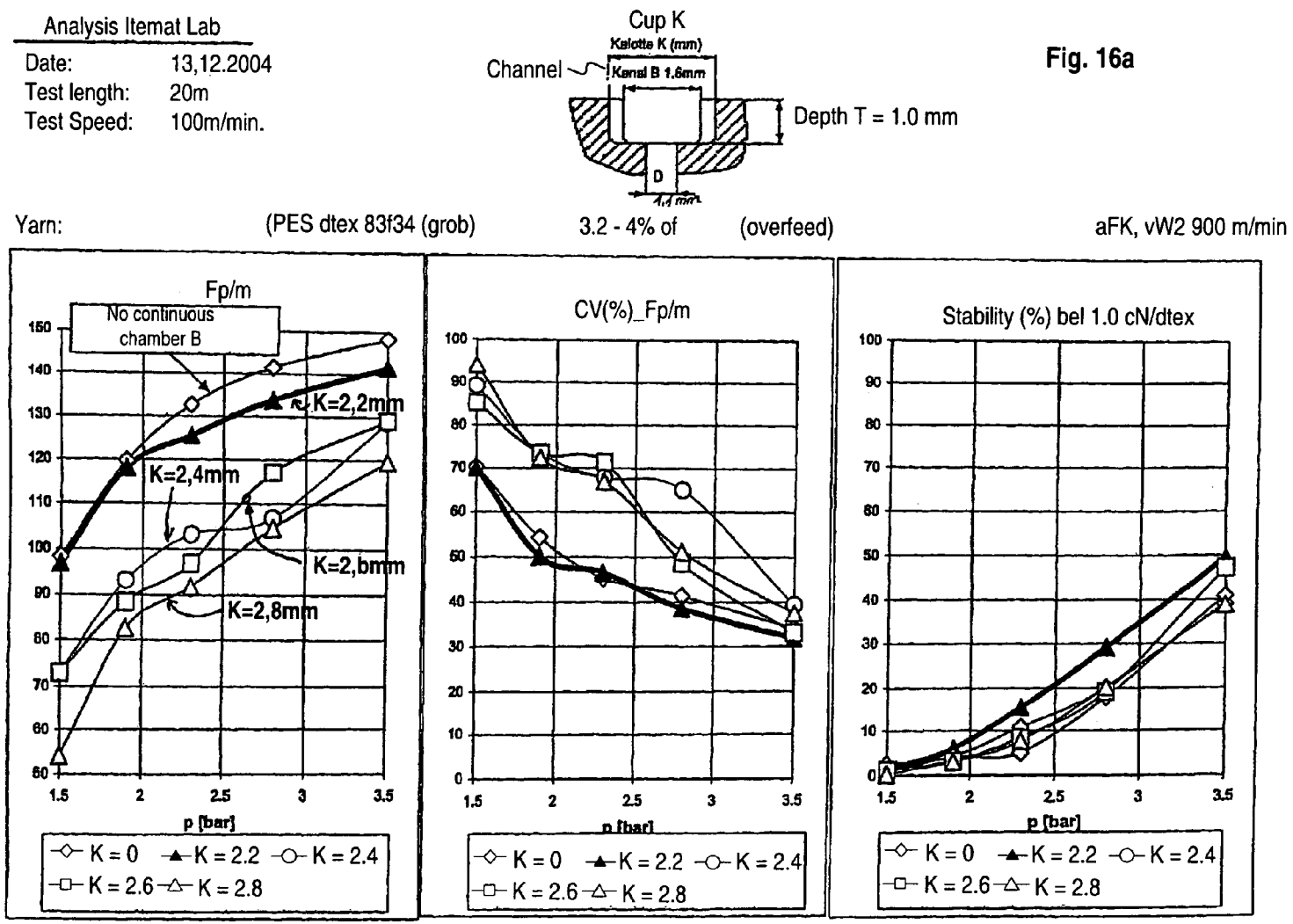
Figure 16B:
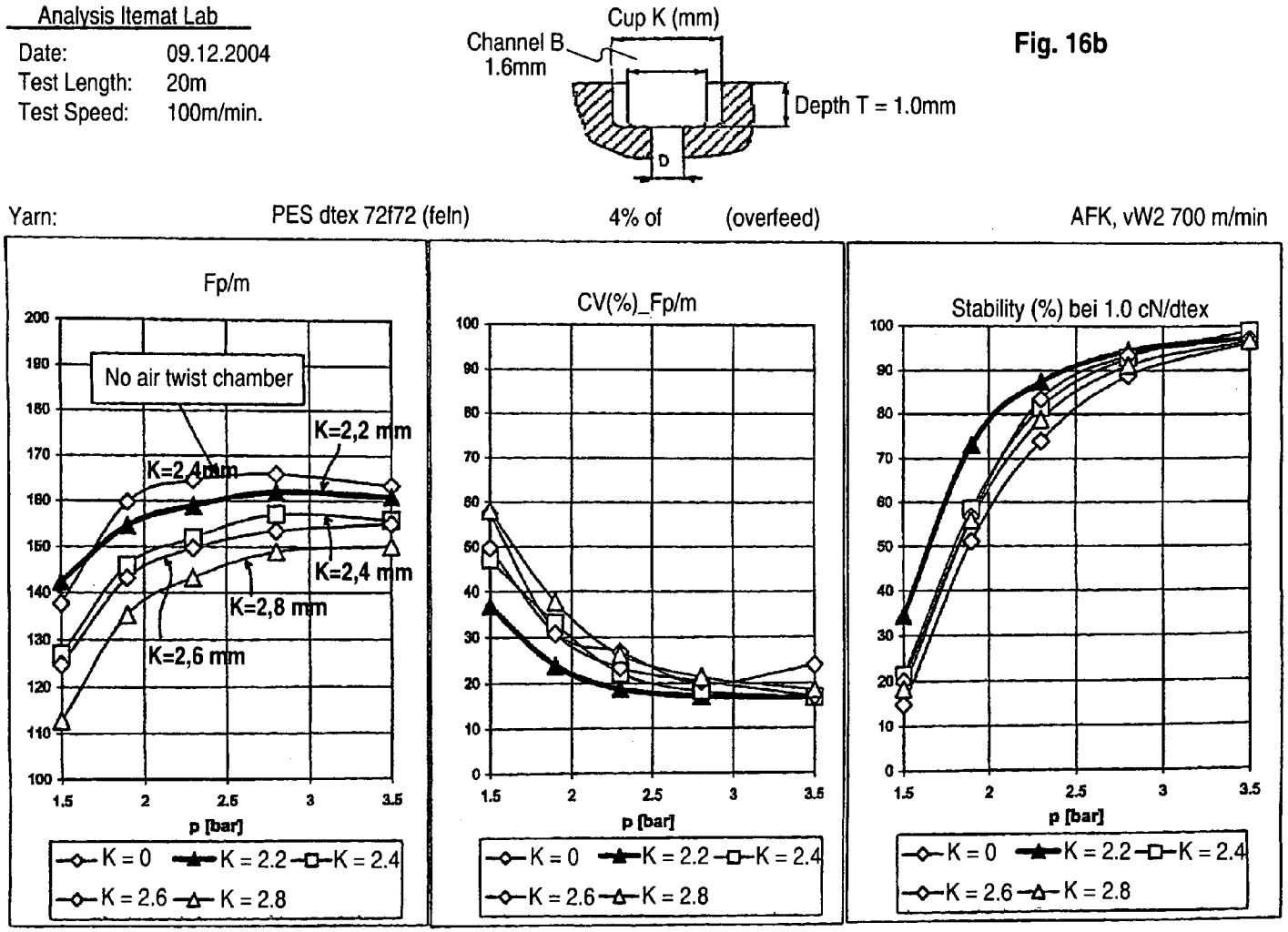
Figure 17:
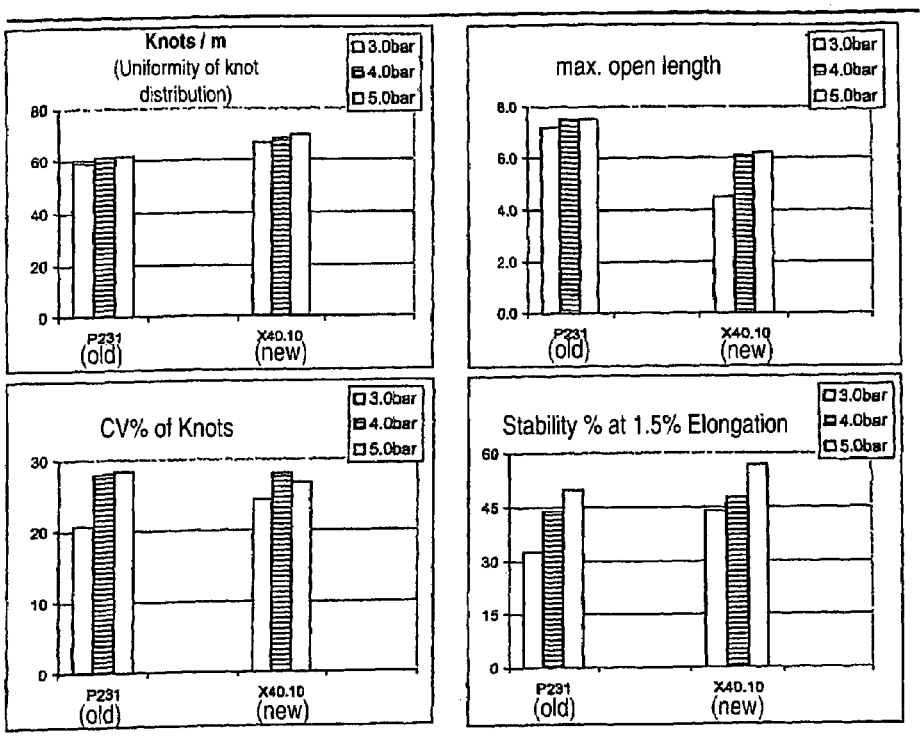

FIGS. 15*a* through 15*c* show a comparison of results with state-of-the-art approaches (FIGS. 15*a* and 15*b*) and with the novel approach (FIG. 15*c*);

FIGS. 16*a* and 16*b* show important quality differences from comparative laboratory tests with state-of-the-art approaches and with the novel invention;

FIG. 17 shows the experimental results with a comparison with and without the air twist chamber using smooth yarn (flat yarn, fully drawn) with different air feed pressures.

METHODS AND EMBODIMENT OF THE INVENTION

FIGS. 1*a* through 1*f* show the classical model for producing a knotted yarn 2' by using an entanglement nozzle 1. In doing so, with the individual filaments, knots K are formed in an unentangled smooth yarn 2 by the action of blown air BL in a yarn treatment channel 3, these knots being formed in the direction of yarn transport 7 as well as opposite the direction of yarn transport within the yarn treatment channel 3 from a double eddy formed by the blown air according to the traditional understanding. Blown air BL enters through a blown air channel 4 in the direction of the arrow 5 and creates the typical double eddy 6, as indicated in FIGS. 1*b* and 1*d*. The knotted yarn 2' leaves the entanglement nozzle 1 according to arrow 8. The yarn treatment channel 3 has a round cross section according to FIGS. 1*a* and 1*b*. The same thing is also true of the blown air channel 4. The approach according to FIGS. 1*c* and 1*d* likewise corresponds to the state of the art and constitutes an improved approach inasmuch as the yarn channel 3 is formed by a semicircular shape in nozzle plate 9 and flat cover plate 10. Due to this specific design, essentially more pronounced double eddies 6 are formed, as illustrated in FIG. 1*d*.

Large-scale investigations have recently revealed that the knot formation results have been very incomplete. In fact, knots are not formed simply from the two stable double eddies 6. The following fact is a basic prerequisite for formation of knots:

a) It is true that a double eddy is created with the blown air jet BL in the yarn treatment channel (FIGS. 1*b* and 1*d*).

b) However, according to FIGS. 1*c* and 1*f*, the double eddy is completely destroyed when a filament yarn 2 enters the yarn treatment channel 3. Within milliseconds, the stable double eddies are destroyed on entrance of the yarn. A one-sided eddy 6* is formed in the one half of the yarn treatment channel while the eddy 6 collapses. As a result, all the filaments in the yarn treatment channel 3 oscillate to the right side. The collection of all filaments on the right side, however, immediately destroys this double eddy, so that a large eddy 6*** is almost immediately established on the left side accordingly (FIG. 1***b*). This oscillation movement is a completely non-steady continuous state in the presence of blown air and filament yarn, ultimately being the cause of knotting.

Figure 2B:
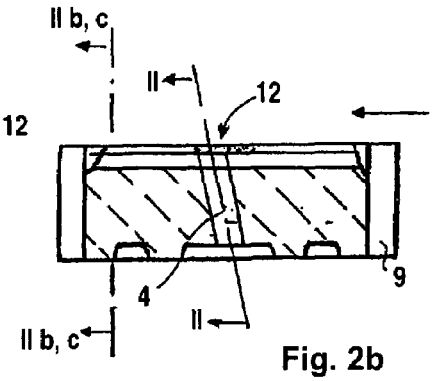
Figure 2C:
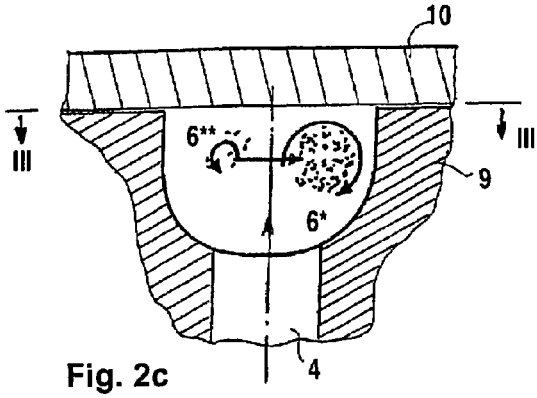
Figure 2D:
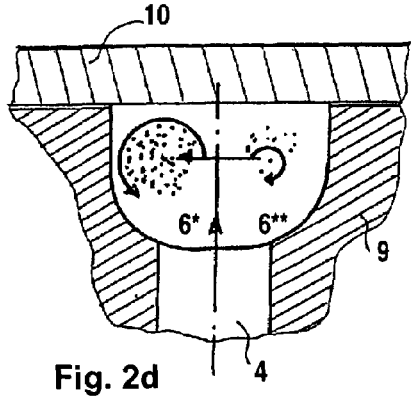

FIGS. 2*a* through 2*d* illustrate an inventive approach. In contrast with FIGS. 1*c* through 1*f*, the yarn treatment channel 3 additionally has an air twist chamber 11, which constitutes a direct continuation of the blown air feed channel 4 into the yarn treatment channel 3. The yarn treatment channel 3 is enlarged in a cup shape at the location of the blown air feed channel 4, as can be seen from a corresponding cup 12 in FIG. 2*b*. This results in an additional eddy current in a section II, II in FIG. 4 according to the two arrows 13, 13' in FIG. 2*b*. The cup-shaped enlargement allows a locally stationary eddy current without any negative effect of the non-stationary eddy movement in the subsequent part of the yarn treatment channel 3. The locally stationary eddy current instead develops directly into the non-stationary eddy flow according to FIGS. 2*c* and 2*d*. FIG. 2*b* shows a nozzle plate 9 designed according to the invention. The same reference numerals have been used for the same features as those selected for FIGS. 1 and 2. The miniaturization of the air twist chamber is clearly discernible here, the air twist chamber being designed to be only large enough so that the filament bundle cannot move in it.

FIGS. 3*a* through 3*c* illustrate three different cross-sectional shapes for the blown air feed channel. FIG. 3*a* shows a circular shape 4', FIG. 3*b* shows a half oval shape 4" and FIG. 3*c* shows an oval shape 4'".

The FIGS. 4*a* and 4*b* each show the result of a CFD flow calculation. FIG. 4*a* shows very clearly the blown air feed BL from bottom to top. The upper plane labeled as E represents the impact surface of the blown air stream BL on the baffle plate 10. The air twist chamber 11 is formed by the two small cup-shaped recesses 12. FIG. 4*a* shows clearly the two eddy currents 14, which form a very stable flow form in an area smaller than 1 to 2 mm in the longitudinal direction. Based on the same model calculation (without the presence of yarn), FIG. 4*a* shows the stationary eddy current 14 in the middle and the two double eddies 6 at the top of the figure. FIG. 4*c* is a drawing that represents schematically the two flow forms.

FIGS. 5*a* through 5*e* illustrate the inventive approach of FIGS. 2 through 4, mounted in a concrete nozzle plate 9 for a SlideJet nozzle.

FIGS. 6*a* and 6*b* show an entire entanglement nozzle 1 designed as a SlideJet. FIG. 6*b* shows the open position, i.e., the threading position, while FIG. 6*a* shows the closed operating position. A nozzle plate 9 is installed in the entanglement nozzle 1, with a sliding part 23 being movable back and forth on the lower leg of a yoke 25. The sliding movement is accomplished by a shift lever 26, which converts the rotational movement into a linear movement by a corresponding mechanical means. The rotational movement of the shift lever 26 is converted into a pure sliding movement according to arrow 27. A baffle plate 10, which is pressed continuously against the upper planar surface of the nozzle plate 9 under spring pressure, is very important for the entanglement effect. The flat planar surface with a high surface fineness allows movement with a simultaneous sealing function, to which end a baffle plate 10 in ceramic and a nozzle plate 9 in ceramic are especially suitable. The yarn channel 3 and an air feed channel are mounted in the nozzle plate 9. For the operating position, the air feed channel can be connected to a compressed air source 22. In the operating position, the yarn channel 3 is determined by the part visible in FIG. 6*a* and by the lower planar surface of the baffle plate 10. FIG. 6*c* shows a nozzle plate 9. FIG. 6*d* shows an entire sliding part 23 with the nozzle plate 9 inserted. FIG. 6*d* also shows that many possible approaches are left open with the mounting of the nozzle plate 9 in the sliding part 23. The nozzle plate 9 may be cast directly in the sliding part 23, e.g., by an injection casting process, so that the ceramic disk and the sliding part 23 form an inseparable component. Furthermore, it would also be possible to cement the ceramic disk in the sliding part.

Figures 7A, 7B, 7C, 7D, 7E, 7F:
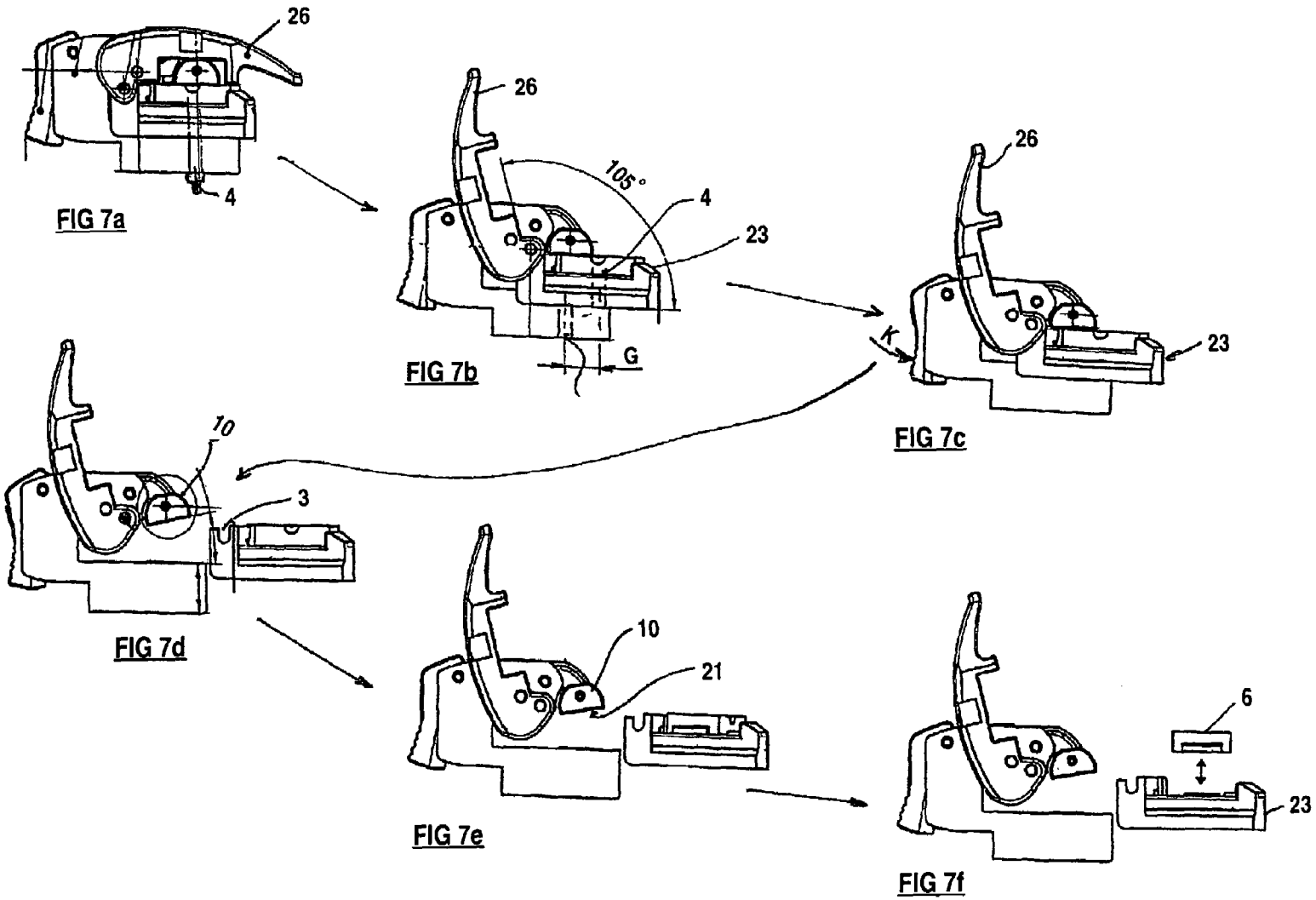

FIG. 7*a* illustrates the closed operating position. The shift lever 26 is in a lowered position of the yarn channel 3 for the passage of the yarn for an air treatment, to which end, compressed air can be supplied through a connection and/or a compressed air bore. The sliding part 23 is shifted forward by the upward movement of the shift lever 26 (FIG. 7*c*) and at the same time the air feed is stopped; this is accomplished with the offset of the two compressed air feed bores by the dimension G. By depressing a release lever according to arrow K, the spring compressive force over the baffle plate 10 is eliminated and the engagement of a shift axle in an engagement groove is released, so that the sliding part 23 can be shifted freely forward (FIG. 7*b*). The sliding part 23 may then be removed from the device (FIG. 7*f*) and the ceramic disk may be removed from the sliding part 23 in the opposite direction. The parts are reinserted in the opposite directions from those in FIGS. 7*a* through 7*f*.

Figures 8A, 8B, 8C, 8D:
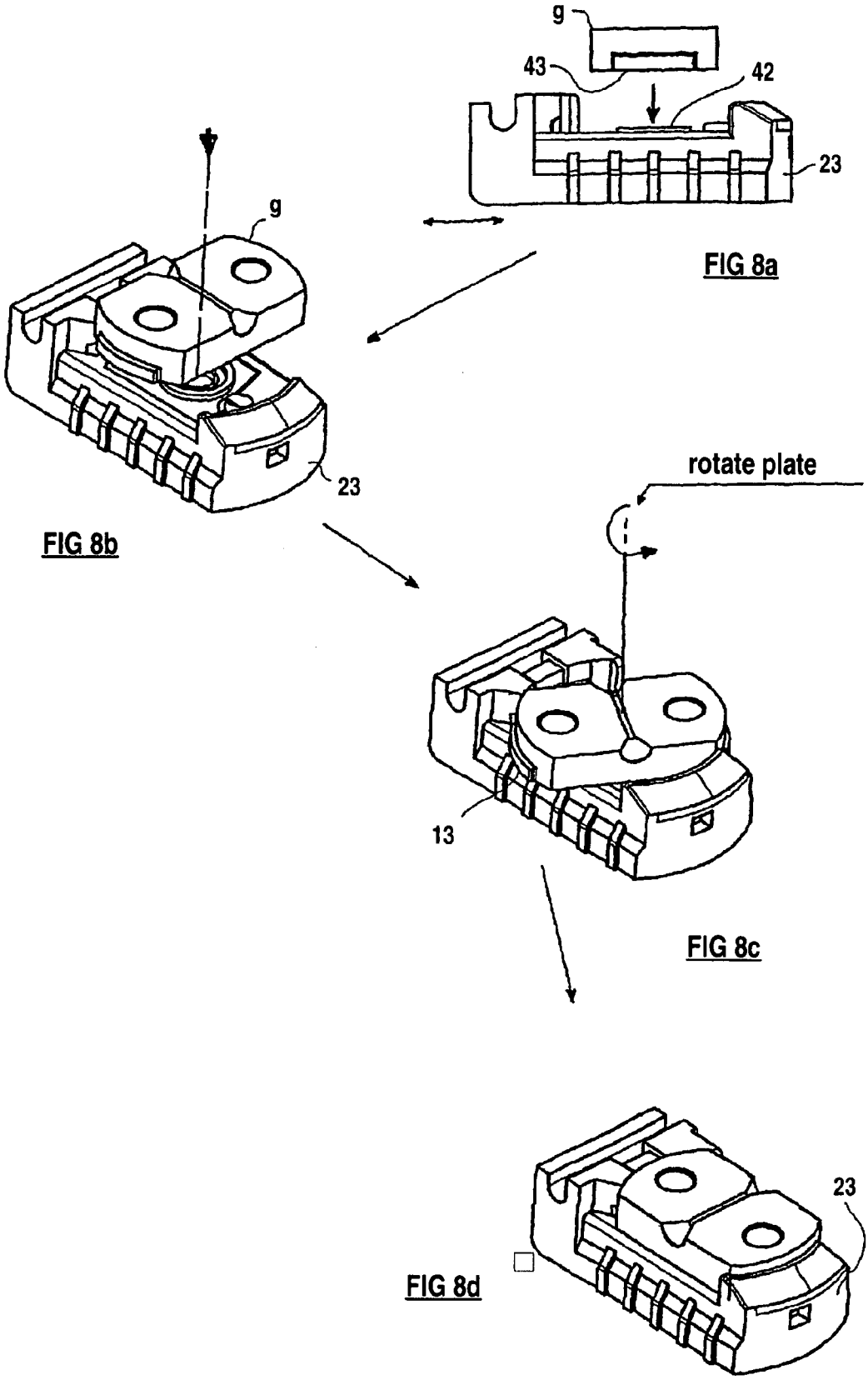

FIGS. 8*a* through 8*c* illustrate a very specific advantageous connection. FIG. 8*a* shows the first step for installation of nozzle plate 9. The nozzle plate 9 is placed on the sliding part 23 across the sliding direction according to arrow 41. A negative part 42 and a positive part 43 help to place the nozzle plate 9 manually in a precise manner, as shown in a perspective view in FIG. 8*b*. In FIG. 8*d* the nozzle plate 9 is placed completely on the sliding part 23, with the rotational movement of the nozzle plate 9 according to the arrow being discernible already. The nozzle plate 9 has a cam on both sides and the sliding part 23 has a round sliding guide that fits with the former. The nozzle plate 9 has circular segments on both sides with respect to a center of rotation, said circular segments fitting in the corresponding circular guides of the sliding part 23 with a slight play. After conclusion of the rotational movement according to FIG. 8*d*, there is a catch location which engages from beneath with a slight spring pressure and secures the nozzle plate 9 in the operating position.

FIG. 9*a* shows untwisted yarn 2. However, this yarn may also be smooth or may be textured with a false twist. The individual filaments 45 are indicated with straight lines. FIG. 9*b* illustrates a softly entangled yarn. Knots K, which tend to be shorter, are typical here, the knots being represented by thin straight lines. FIG. 9*c* shows hard knots K that are relatively long between the open entangled locations. The hard knots are represented by thicker lines. FIG. 9*d* illustrates a typical knotted yarn according to the state of the art with very irregular knots.

FIGS. 10*a* through 10*c* show a few examples with irregular knot formation.

FIG. 11 shows a comparison of hard and soft knots that can be created with the novel invention. FIG. 11 shows a typical respective area of use of compressed air at 1.5 to 3 bar and/or 0.5 to 1.5 bar. Hard or soft knots are demanded, depending on the market and especially the type of further processing.

FIGS. 12*a* and 12*b* illustrate the possibility of using a Y-shaped blown air channel cross section with a corresponding main air channel H and secondary air channel N. FIG. 12*c* shows another example of the embodiment of an inventive air twist chamber 11'.

FIGS. 13*a* through 13*c* illustrate an approach according to the state of the art, which the present applicant has already been manufacturing for more than 20 years. A long yarn entanglement chamber with a relatively large width and length is typical here. Behind this approach there is the model wherein the yarn oscillation can decay as far as possible in the yarn twist chamber.

FIG. 14*a* shows an approach in accordance with the invention and two state-of-the-art approaches for comparison (FIGS. 14*b*, 14*c*). All previous investigations have shown that there is a critical measure for the protrusion of the air twist chamber. This is approx. 0.5 mm. In all chamber embodiments where the chamber protrudes laterally by more than 0.5 mm, a tangible decline in quality is found. Previous experiments have shown that lateral protrusion of the chamber beyond the yarn treatment channel 3 must be regarded as critical. It has been found that the chamber is advantageously less than 1.3×yarn channel width (W) long in the longitudinal direction of the yarn channel.

FIGS. 15*a*, 15*b* and 15*c* show a comparison of the knot formation: FIG. 15*a* illustrates an approach according to FIGS. 13*a* through 13*c*, FIG. 15*b* illustrates an approach without [an air] twist chamber according to FIGS. 1*a* and 1*b* and FIG. 15*c* illustrates the approach in accordance with the invention. In all three approaches, yarns of 80 f 72, 80 f 108, 72 f 72 and 80 f 34, for example, are used. Soft or hard knots are formed, depending on the mode of operation and/or the pressure of the blown air.

The two FIGS. 16*a* and 16*b* show results with comparative experiments, FIG. 16*a* with coarse yarn and FIG. 16*b* with fine yarn. The figure at the left shows the number of knots per meter, the middle figure shows the scattering in the knots and the figure on the right shows the stability and/or loss of knots under tensile stress. Nozzles with no chamber or nozzles with roundish chambers were used (with cup widths K of 2.2, 2.4, 2.6, 2.8 mm). The [air twist] chambers were embodied in a cup-shaped design. It can be seen clearly that the best results were achieved with the inventive cup width K of 2.2 mm with a true inventive air twist chamber. The yarn channel width in all experiments was 1.6 mm, the yarn channel depth was 1.0 mm and the air blowing bore was 1.1 mm. The inventive advantages are also achieved when additional elasthane yarns are introduced into the nozzle and combined with the filament yarns mentioned in the introduction.

The invention claimed is:

1. A method of producing fine filament knotted yarn by means of air nozzles, comprising:

blowing air across a yarn treatment channel, the yarn treatment channel including a micro-eddy chamber configured as a blown air channel enlargement of less than 22% but more than 5% of the yarn channel width;

forming a first double eddy in a direction of conveyance of the yarn;

forming a second double eddy opposite a direction of conveyance of the yarn; and producing two strong contra-rotating stationary eddy currents that are substantially undisturbed by a filament bundle in an inlet area of the yarn treatment channel in the micro-eddy chamber.

2. The method of claim 1, further including:

creating a short area with a stable twist flow in an air twist chamber; and alternating eddy zone in a direction of yarn transport as well as opposite the direction of yarn transport.

3. The method of claim 1, further including:

blowing air having a pressure of 0.5 to 1.5 bars to produce soft knots, which can be undone during further processing.

4. The method of claim 1, further including:

blowing air having a pressure of more than 1.5 bars to produce hard knots, which remain substantially intact during further processing.

5. The method of claim 1, further including:

treating yarns that are finer than 10 to 15 dpf.

6. The method of claim 1, further including:

treating yarns that are finer than 2 dpf.

7. The method of claim 1, further including:

designing the yarn channel width to be semicircular or U-shaped, the yarn channel width being greater than the yarn channel depth.

8. The method of claim 2, wherein the air twist chamber constitutes a cup shaped air channel enlargement in the yarn channel, and air flows along a path similar to the shape of the air channel with respect to a cross section through the yarn channel.

9. The method of claim 2, wherein the air twist chamber is designed to be at least approximately symmetrical with the central axis of the yarn channel and protrudes on both sides beyond lateral yarn channel walls by less then 0.5 mm or between 5% and 22% of the yarn channel width.

10. The method of claim 2, wherein the air twist chamber protrudes beyond the blown air channel by less than 0.5 mm and by at most 22% and at least 5% of the yarn channel width in a longitudinal direction of the yarn channel.

11. The method of claim 2, further including:

miniaturizing the air twist channel to prevent the filament bundle from penetrating a lateral enlargement of the air twist chamber.

12. The method of claim 1, wherein yarn is selected from microfilament knotted yarn, entangled yarn from DTY, and smooth yarns with highly regular knots.

13. An entanglement nozzle for producing fine knotted yarn, comprising:

a continuous yarn treatment channel;

a blown air feed channel directed at a central longitudinal axis of the yarn treatment channel; and a blown air feed channel enlargement formed in the opening area of the blown air feed channel in the yarn treatment channel, the blown air feed channel defining a micro-eddy chamber for two contra-rotating stationary eddy currents, the blown air feed channel enlargement protruding by less than 22% but more than 5% of the yarn channel width.

14. The entanglement nozzle of claim 13, wherein the yarn treatment cross section is designed to be semicircular or U-shaped with a planar baffle cover.

15. The entanglement nozzle of claim 13, further including an air twist chamber configured as a miniaturized cup having a similar shape laterally with respect to the yarn treatment channel cross section.

16. The entanglement nozzle of claim 15, wherein the air twist chamber protrudes by less than 0.5 mm on both sides of the yarn treatment channel.

17. The entanglement nozzle of claim 15, wherein the length of the air twist chamber in a longitudinal direction of the yarn channel is less than 1.3 times the yarn channel width.

18. The entanglement nozzle of claim 15, wherein the air twist chamber has an approximately circular symmetrical outer contour and preferably forms a continuation of the central axis of the blown air feed channel.

19. The entanglement nozzle of claim 13, wherein the width of the yarn cross section is greater than the depth of the yarn channel in the direction of the blown air feed to intensify lateral formation of eddies in the air.

20. The entanglement nozzle of claim 13, wherein the yarn treatment channel is configured as a wide channel with a width of about 0.6 to 3 mm, and with a ratio of the yarn channel width to the yarn channel depth of between about 1.1 to 2.5.

21. The entanglement nozzle of claim 13, wherein the air blown feed channel is designed to be round or oval with a triangular character or Y-shaped, and the side dimension of the blown air feed channel is at most equal to or less than a corresponding yarn channel width.

22. The entanglement nozzle of claim 13, wherein the yarn channel width is greater than the air feed channel width with a ratio of yarn channel width to air feed channel width of between about 1.2 to 3.

23. The entanglement nozzle of claim 13, wherein the yarn channel is formed by a planar displaceable baffle plate and a nozzle plate with blown air feed.

24. The entanglement nozzle of claim 13, wherein the yarn channel is formed by a nozzle plate and a baffle plate that is displaceable in relation thereto, and as a slide jet with an open position of the yarn channel for threading the yarn into it and a closed position of the yarn channel for producing a knotted yarn.

25. The entanglement nozzle of claim 13, further including a nozzle plate configured as a plate-shaped ceramic disk, and wherein the ceramic disk together with a sliding part can be installed into and removed from the entanglement nozzle.

26. The entanglement nozzle of claim 13, configured to produce knotted yarn from BCF yarns.

27. An entanglement nozzle for producing fine knotted yarn, comprising:

a continuous yarn treatment channel;

a blown air feed channel directed at a central longitudinal axis of the yarn treatment channel; and a blown air feed channel enlargement formed in the opening area of the blown air feed channel in the yarn treatment channel, the blown air feed channel enlargement defining a micro-eddy chamber for two contra-rotating stationary eddy currents; the blown air feed channel enlargement protruding by less than 0.5 mm on both sides of the yarn treatment channel.

* * * * *